US006319090B1

(12) United States Patent
Gross

(10) Patent No.: US 6,319,090 B1
(45) Date of Patent: Nov. 20, 2001

(54) GRAPHICS ENHANCED MULTIPURPOSE BANDANNA AND BALL

(76) Inventor: Lawrence W. Gross, 1942 Stevenson Dr., Ames, IA (US) 50010

( * ) Notice: Subject to any disclaimer, the term of this patent is extended or adjusted under 35 U.S.C. 154(b) by 0 days.

(21) Appl. No.: 09/573,004

(22) Filed: May 17, 2000

(51) Int. Cl.[7] ..... A63H 33/00; A42B 19/02

(52) U.S. Cl. ..... 446/487; 446/488; 446/26; 2/171

(58) Field of Search ..... 446/26, 27, 488; 434/433, 365, 395, 399, 400; 2/171, 172, 207, 202, 204, 206, DIG. 11

(56) References Cited

U.S. PATENT DOCUMENTS

| | | | | |
|---|---|---|---|---|
| 1,845,279 | * | 2/1932 | Iwan | 2/172 |
| 1,909,686 | * | 6/1933 | Kindall | 2/172 |
| 3,440,660 | * | 4/1969 | Krinke | 2/410 |
| 4,468,818 | * | 9/1984 | Flannery | 2/207 |
| 4,993,080 | * | 2/1991 | Doty | 2/181 |
| 5,058,211 | * | 10/1991 | Hanks | 2/206 |
| 5,282,749 | * | 2/1994 | Ketch | 434/395 |
| 5,465,689 | * | 11/1995 | Winder | 119/654 |
| 5,594,956 | * | 1/1997 | Barrientons | 2/171 |
| 5,608,914 | * | 3/1997 | Kessler | 2/207 |
| 5,685,016 | * | 11/1997 | Douglas | 2/171 |
| 5,906,006 | * | 5/1999 | Astro, Jr. | 2/207 |
| 6,032,292 | * | 3/2000 | Wood et al. | 2/207 |

* cited by examiner

*Primary Examiner*—Jacob K. Ackun, Jr.
*Assistant Examiner*—Faye Francis
(74) *Attorney, Agent, or Firm*—Daniel A. Rosenberg; Kent A. Herink; Davis Brown Law Firm

(57) ABSTRACT

A bandanna is provided with a graphics display area defined on at least one side of the bandanna. The graphics display area is defined on each side by a first and second guideline that extend the length of the bandanna. The first and second guidelines are joined together at a terminal end by a third guideline. The bandanna is initially folded along a center folding line, wherein the graphics display area is substantially centered and adjacent to the center folding line. Next, the bandanna is repeatedly folded and wrapped in a manner that creates successive folding lines each substantially parallel to the center folding line. The folding and wrapping continues until one of the folding lines reaches the third guideline. A tip portion is folded about the third guideline thereby creating a pocket. Then, each side of the bandanna is repeatedly folded and stacked about the first and second guidelines, first one side and then the other. Finally, the bandanna is successively reverse folded by turning the pocket inside out, thereby creating successive pockets, until the graphics display area is displayed.

6 Claims, 4 Drawing Sheets

GRAPHICS ENHANCED MULTIPURPOSE BANDANNA AND BALL

BACKGROUND OF THE INVENTION

The present invention relates to a bandanna for folding and a method of folding a bandanna. In particular, the invention relates to a bandanna for folding and a method of folding a bandanna for presentation of a graphics display area.

The area of games and devices available to hold the interest of children and adults is nearly limitless. In particular, those games and devices that challenge the imagination and stimulate learning skills are of even more significance. The development of dexterity, mathematical, and visualization skills serve very useful purposes. It is certainly an advantage to combine such learning, skills with a fun recreational activity. Thus, a need exists for a fun activity that combines useful learning skills for the entertainment and education of children and adults.

SUMMARY OF THE INVENTION

An object of the present invention comprises providing a bandanna for folding to present a graphics display area.

A further object of the present invention comprises providing a bandanna for use in an educational activity.

Still another object of the present invention comprises providing a bandanna for use in a recreational activity.

These and other objects of the present invention will become apparent to those skilled in the art upon reference to the following specification, drawings, and claims.

The present invention intends to overcome the difficulties encountered heretofore. To that end, a bandanna is provided with a graphics display area defined on at least one side of the bandanna. The graphics display area is defined on either side by a first and second guideline that extend the length of the bandanna. The first and second guidelines are joined together at a terminal end by a third guideline. The bandanna is initially folded along a center folding line, wherein the graphics display area is substantially centered and adjacent to the center folding line. Next, the bandanna is repeatedly folded and wrapped in a manner that creates successive folding lines each substantially parallel to the center folding line. The folding and wrapping continues until one of the folding lines reaches the third guideline. A tip portion is folded about the third guideline thereby creating a pocket. Then, each side of the bandanna is repeatedly folded and stacked about the first and second guidelines, first one side and then the other. Finally, the bandanna is successively reverse folded by turning the pocket inside out until the graphics display area is displayed.

DETAILED DESCRIPTION OF THE INVENTION

Figure 1:
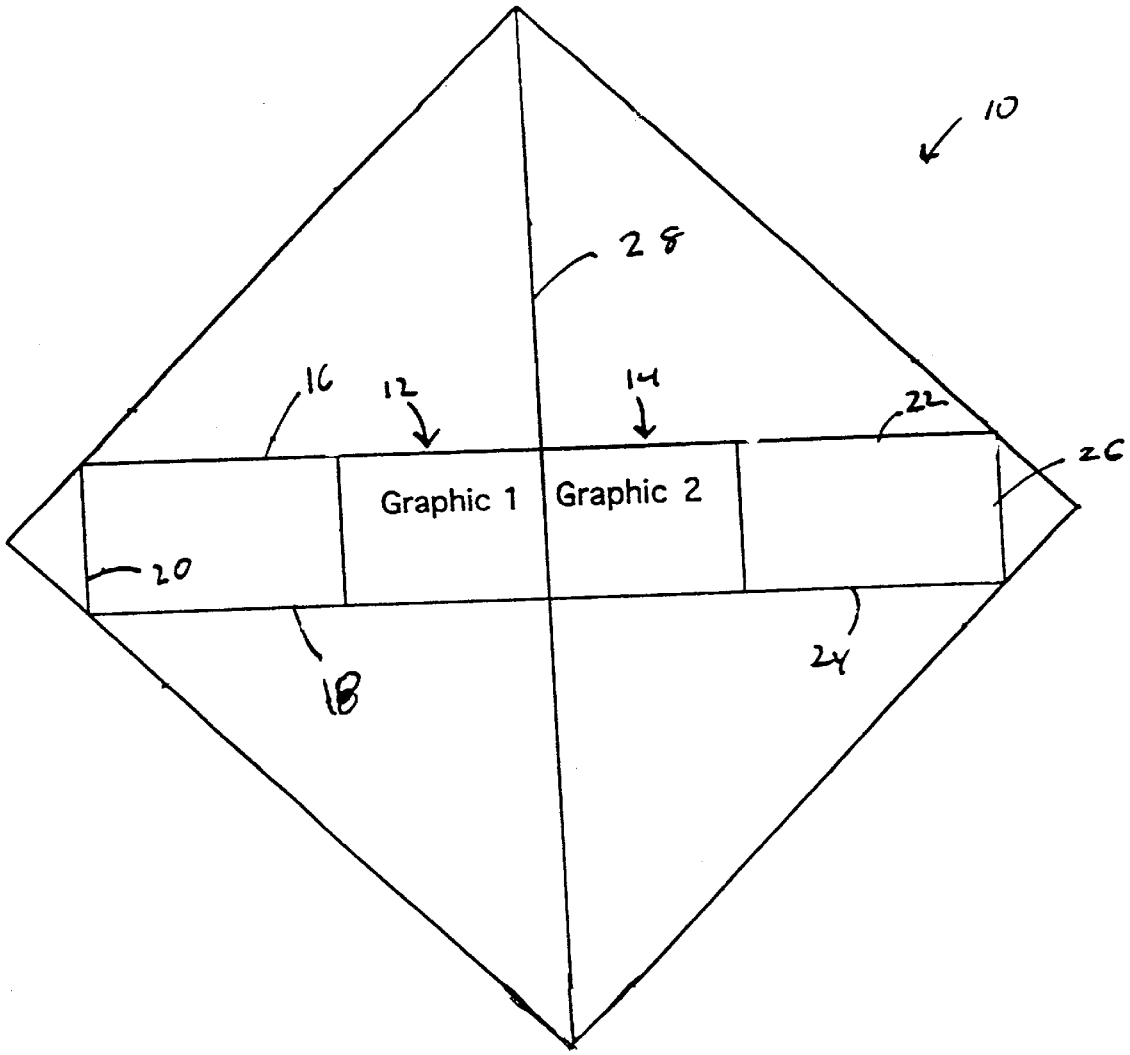
FIG. 1 is a top plan view of an unfolded bandanna.

In the Figures, FIG. 1 shows a bandanna 10 with a first graphics display area 12 and a second graphics display area 14. The graphics display areas 12, and 14 straddle a center folding line 28. In the preferred embodiment of the invention, the center folding line 28 runs diagonally from one end of the bandanna 10 to the other. The first graphics display area 12 also includes a first guideline 16 and a second guideline 18 that extend away from the upper and lower ends of the first graphics display area 12. The first and second guidelines 16, and 18 of the first graphics display area 12 extend away from the center folding line 28 towards the edge of the bandanna 10 to a point where they intersect with a third guideline 20 of the first graphics display area 12.

In a similar manner, the second graphics display area 14 includes a first guideline 22, a second guideline 24, and a third guideline 26. FIG. 1 shows that the first and second graphics display areas 12, and 14, and the respective guidelines appear in a mirror image orientation about the center folding line 28. In alternative embodiments, the possibility exists for adding additional graphics display areas. For example, graphics display areas can be located on either side of the bandanna 10, or additional graphics display areas can be located adjacent to a second center folding line (not showing) located perpendicular to the center folding line 28. In this manner each side of the bandanna 10 could conceivably contain four graphics display areas. Although, in this orientation the graphics display areas would overlap to a certain degree.

Furthermore, it is not necessary that the graphics of the bandanna 10 conform identically in size to the size of the first and second graphics display areas 12, and 14. For example, the graphics may extend across the entire bandanna; however, only that portion contained within one of the graphics display areas 12, and 14 would ultimately appear on the outside of the wrapped bandanna 10. In other words, the method of the present invention would work with a traditional printed bandanna.

Furthermore, it is not necessary for the center folding line of the bandanna 10 to conform identically to the location of the center folding line 28. For example, the center folding line 28 may not appear on the bandanna 10. In this case, the center fold would proceed by estimation. In other words, the method of the present invention would work with a traditional printed bandanna.

Furthermore, it is not necessary for the guidelines of the bandanna 10 to conform identically to the location of the guidelines 16, 18, and 20, and of the guidelines 22, 24, and 26. For example, the guidelines 16, 18, and 20, and the guidelines 22, 24, and 26 may not appear on the bandanna 10. In this case, the folding and stacking of the bandanna would proceed by estimation. In other words, the method of the present invention would work with a traditional printed bandanna.

Figure 2:
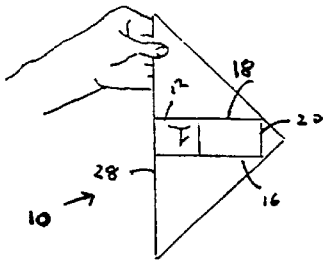
FIG. 2 is a top plan view of the bandanna of FIG. 1 folded diagonally.

The method of folding the bandanna proceeds according to the following description and in reference to FIGS. 2–18. The first step involves folding the bandanna 10 along the center folding line 28. FIG. 2 shows that one side of the bandanna 10 shows the first graphics display area 12 and its associated guidelines 16, 18, and 20, while the other side of the bandanna 10 would display the second graphics display area 14 and its associated guidelines 22, 24, and 26.

Figure 3:
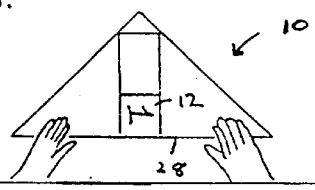
FIG. 3 is a top plan view of the bandanna of FIG. 2.
Figure 4:
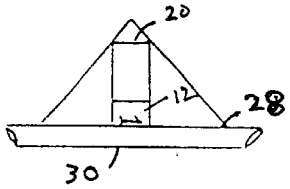
FIG. 4 is a top plan view of the bandanna of FIG. 3 after a first successive fold along a center folding line.

The next step, shown in FIG. 3, requires orienting the bandanna 10 on a flat surface such that the center folding line 28 faces the user. Oriented in the manner shown in FIG. 2, the first graphics display area 12 will eventually be on the outside of the wrapped bandanna 10. Of course, the user can easily manipulate the starting position of the bandanna 10 to place the graphics display area for ultimate display in the orientation shown in FIG. 3. The next step, shown in FIG. 4, begins by folding the bandanna 10 about the center folding line 28 toward the third guideline 20 of the first (graphics display area 12. In this manner, the fold creates a successive folding line 30, thereby moving the center folding line 28 toward the third guideline 20 of the bandanna 10. Folding the bandanna 10 by an amount that divides the first graphics display area 12 in half allows for the ultimate display of the entire first graphics display area 12 upon completion of the method. Initial folds of greater or lesser amounts, however, are possible depending on the effect desired upon completion of the method.

Figure 5:
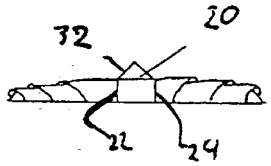
FIG. 5 is a top plan view of the bandanna of FIG. 4 successively folded up to a third guideline.

The folding continues until the bandanna 10 appears in the manner shown in FIG. 5. Repeatedly folding and wrapping the bandanna upon the successively created folding lines, with each folding line substantially parallel to the original center folding line 28, will leave only the tip 32 of the bandanna 10 exposed. It is important to remember that the size of the initial fold will determine the size of the successive folds. In other words, each successive fold folds about the previous folding line.

Figure 6:
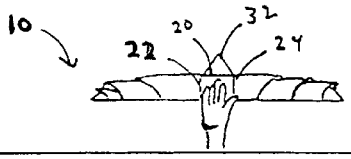
FIG. 6 is a top plan view of the bandanna of FIG. 5 showing the placement of the user's right hand.
Figure 7:
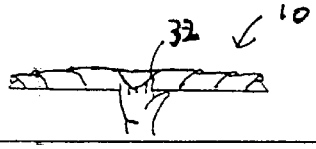
FIG. 7 is a top plan view of the bandanna of FIG. 6 showing the user's right hand and a folded tip.
Figure 8:
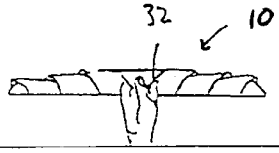
FIG. 8 is a top plan view of the bandanna of FIG. 7 showing the user's right hand holding the tip.
Figure 9:
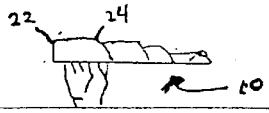
FIG. 9 is a top plan view of the bandanna of FIG. 8 with the left side of the bandanna partially folded.
Figure 10:
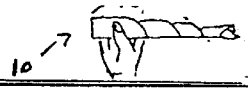
FIG. 10 is a top plan view of the bandanna of FIG. 9 with the user's right hand holding the partially folded bandanna.
Figure 11:
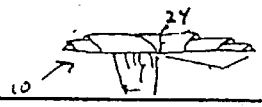
FIG. 11 is a top plan view of the bandanna of FIG. 10 with the left side of the bandanna partially folded and stacked.
Figure 12:
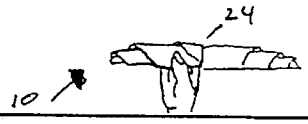
FIG. 12 is a top plan view of the bandanna of FIG. 11 with the user's right hand holding the partially folded and stacked bandanna.
Figure 13:
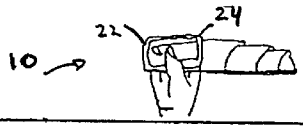
FIG. 13 is a top plan view of the bandanna of FIG. 12 with the user's right hand holding the folded and stacked left side of the bandanna.
Figure 15:
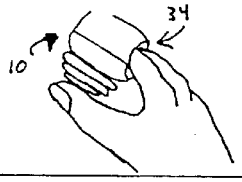
FIG. 15 is a side elevational view of the bandanna of FIG. 14 showing the user's right hand in a pocket.

The bandanna 10 depicted in the manner shown in FIG. 5 and FIG. 6 leaves the first and second guidelines 22, and 24 of the second graphics display area 14 exposed, along with the third guideline 20 of the first graphics display area 12. In other words, successive folding and wrapping of the bandanna 10 result in covering the first graphics display area 12 and exposing at least a portion of the underlying second graphics display area 14. The next step in the method shown in FIGS. 6, 7, and 8 involves placing the user's right hand in the center of the folded bandanna 10, and with the left hand folding the tip 32 along the third guideline 20 and over the fingertips of the right hand thereby creating a pocket 34. See also FIG. 15, where the pocket 34 consists of that area on either side of the fingertips of the right hand as shown in FIG. 15. Next, shown in FIG. 9, while continuing to hold the tip 32 in the right hand, the left side of the bandanna 10 is folded along the first guideline 22 of the second graphics display area 14. At this point, the bandanna 10 appears in the manner shown in FIG. 9. This begins the process of repeatedly folding and stacking the left side of the bandanna 10 about the first and second guidelines 22, and 24 of the second graphics display area 14. As shown FIGS. 10–13, the portion of the bandanna 10 folded over the second guideline 22 of the second graphics display area 14 continues to be folded and stacked on top of itself until completely folded. In this manner, the former left side of the bandanna 10 is successively and alternately folded about the first guideline 22 of the second graphics display area 14 and then the second guideline 24 of the second graphics display area 14. With each successive fold the right thumb remains on top, and the fingertips in the pocket 34.

Figure 14:
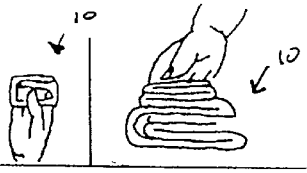
FIG. 14 is a top plan view and a side elevational view of the bandanna of FIG. 13 with the user's right hand holding the completely stacked and folded bandanna.

Again, leaving the fingertips of the right hand in the pocket 34 formed by folding the tip 32 over the third guideline 20 of the bandanna 10, FIGS. 14 and 15 show that the identical process repeats for the right hand side of the bandanna 10. In other words, the right hand side of the bandanna 10 is successively and alternately folded about the second guideline 24 of the second graphics display area 14 and the first guideline 22 of the second graphics display area 14. At this point, the bandanna I0 appears in the manner shown in FIG. 15. In particular, the fingertips of the right hand rest in the pocket 34 while the thumb of the right hand holds the folded and stacked sides of the bandanna 10 in place.

Figure 16:
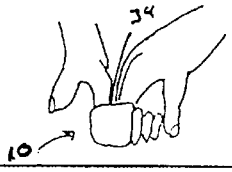
FIG. 16 is a side elevational view of the bandanna of FIG. 15 with the user's left and right hand inserted back-to-back in the pocket.
Figure 17:
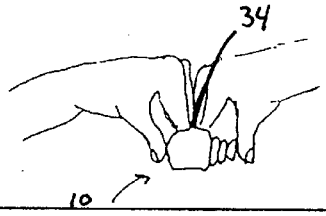
FIG. 17 is a side elevational view of the bandanna of FIG. 16 showing the user's right and left hand holding the bandanna.
Figure 18:
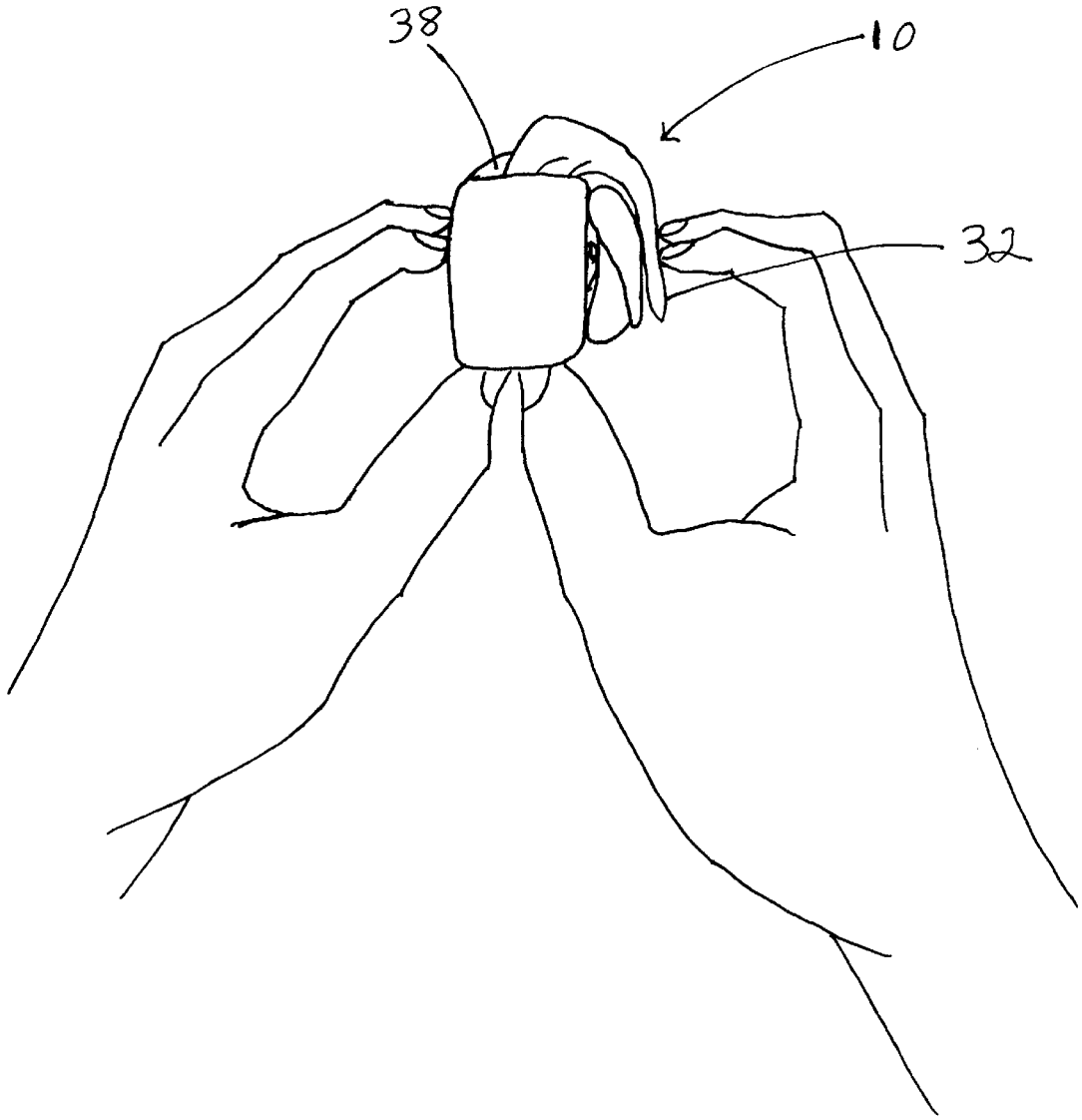
FIG. 18 is a side elevational view of the bandanna of FIG. 17 after a reverse fold, showing the user's right and left fingertips on the outside of the bandanna.

The next portion of the method comprises the step of reverse folding the bandanna 10 by turning the pocket 34 inside out until the first graphics display area 12 is fully displayed. This begins by placing the fingertips of the left hand inside the pocket 34 such that the fingertips of the right hand and the fingertips of the left hand are back-to-back. FIGS. 16–17 show the specific orientation of the hands at this step in the method. Next, by reverse folding the bandanna 10, the pocket 34 is turned essentially inside out such that the outside surfaces held by the right and left thumbs are now on the inside of the bandanna 10 (FIG. 18). In other words, as shown in FIG. 18, the reverse fold essentially reverses the position of the hands such that the right and left fingertips are now on the outside of the bandanna 10, and the right and left thumbs are back-to-back. Next, the thumbs of the right and left hand are moved to the outside of the bandanna 10 beneath the fingertips of the respective right and left hand. Next, by moving the fingertips of the right and left hand into the newly created pocket 38 (FIG. 18) whose opening is on the top left of the bandanna 10, the fingertips are engaged with a new pocket 38 and the reverse folding continues in a manner identical to that previously described in reference to FIG. 17.

This process repeats, each time the fingertips reverse fold the newly created pocket, with the fingertips of the right and left hands winding up on the outside and opposite sides of the bandanna 10, and the thumbs of the right and left hand winding up back-to-back on the bottom of the bandanna 10. Between each reverse folding step, the right and left thumbs move to the outside and opposite sides of the bandanna 10, and the right and left fingertips are inserted into the newly created pocket back-to-back. The reverse folding continues until the first graphics display area 12 is completely displayed on the outside of the bandanna 10. In other words, the process shown in FIGS. 17 and 18 repeats over and over again until there is no longer a pocket 38. At this point, the bandanna 10 is successfully reverse folded. This is the wrapped bandanna 10.

In order to display the second graphics display area 14, or any other graphics display area for that matter, the process is identical to that described except that the bandanna 10 is initially oriented such that the second graphics display area 14, or any other graphics display area, is displayed in an orientation identical to that of the first graphics display area 12 shown in FIG. 2.

In the preferred embodiment of the invention the bandanna 10 is square, although many other shapes are possible. For the square bandanna 10 the ratio of one side of the bandanna 10 to the center folding line 28 to a horizontal axis of one of said graphics display areas is approximately 1:1.4142:0.2613. The horizontal axis of said graphics display area is defined as an axis transverse, and preferably perpendicular, to the center folding line 28. The vertical axis of the graphics display area can vary in length, and will correspondingly vary the length of the third guideline of the graphics display area. Of course, variation in the length of the vertical axis of the graphics display area will result in variations in the width of the wrapped bandanna 10. In other words, the shorter the vertical axis, the shorter the corresponding wrapped bandanna 10. The longer the vertical axis, the longer the corresponding wrapped bandanna 10. The hardness and softness of the wrapped bandanna 10 will also vary in direct proportion to the length of the vertical axis. Thus, the shorter the vertical axis, the harder the wrapped bandanna 10 and the harder it will be to reverse fold the bandanna 10. Of course, the longer the vertical axis, the softer the wrapped bandanna 10 and the easier to reverse fold.

While it is anticipated that both children and adults can use the bandanna 10 and method of folding disclosed herein, children may need some initial assistance from an adult in order to practice the method of the present invention.

The foregoing description and drawings comprise illustrative embodiments of the present invention. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

I claim:

1. A method of folding a bandanna for presentation of a graphics display area, said method comprising:

providing a bandanna comprising a graphics display area, a first guideline, a second guideline, and a third guideline, wherein said first and said second guidelines are substantially parallel to each other and extend across a central portion of said bandanna such that a portion of said first guideline defines a first side of said graphics display area and a portion of said second guideline defines a second side of said graphics display area opposite to said first side, and wherein said first and second guidelines terminate near a first end of said bandanna and said third guideline extends from said first to said second guideline at said first terminal end;

folding said bandanna along a center folding line, wherein said graphics display area is substantially centered and adjacent to said center folding line, repeatedly folding and wrapping said bandanna thereby creating successive folding lines each substantially parallel to said center folding line, until said folding line reaches said third guideline;

folding a tip portion of said bandanna about said third guideline thereby creating a pocket;

repeatedly folding and stacking one side of said bandanna about said first and said second guidelines;

repeatedly folding and stacking the other side of said bandanna about said second and said first guidelines; and successively reverse folding said bandanna by turning said pocket inside out, thereby creating successive pockets, until said graphics display area is displayed.

2. The invention in accordance with claim 1 wherein said bandanna is substantially square and said center folding line extends diagonally from a first corner of said bandanna to a second corner of said bandanna opposite to said first corner.

3. The invention in accordance with claim 1 wherein said step of repeatedly folding and wrapping said bandanna begins by dividing said graphics display area substantially in half and each successive folding line is created by and folded about said previous folding line.

4. The invention in accordance with claim 1 further comprising a second graphics display area oppositely aligned to said first graphics display area about said center folding line, and wherein said first and said second guidelines extend across said central portion of said bandanna to a second terminal end opposite to said first terminal end and a fourth guideline extends from said first to said second guideline at said second terminal end, and wherein a portion of said first guideline defines a first side of said second graphics display area and a portion of said second guideline defines a second side of said second graphics display area opposite to said first side.

5. The invention in accordance with claim 1 wherein said bandanna is square.

6. The invention in accordance with claim 5 wherein the ratio of one side of said bandanna to said center folding line to a horizontal axis of said graphics display area is approximately 1:1.4142:0.2613, wherein said horizontal axis of said graphics display area is an axis parallel to said center folding line extending the length of said graphics display area.

* * * * *